US010271121B2

(12) United States Patent
Evans et al.

(10) Patent No.: US 10,271,121 B2
(45) Date of Patent: Apr. 23, 2019

(54) SHOCK MOUNTED TRANSDUCER ASSEMBLY

(71) Applicant: Apple Inc., Cupertino, CA (US)

(72) Inventors: Neal D. Evans, Sunnyvale, CA (US); Jesse A. Lippert, San Jose, CA (US); Nikolas T. Vitt, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 63 days.

(21) Appl. No.: 15/403,095

(22) Filed: Jan. 10, 2017

(65) Prior Publication Data

US 2018/0091881 A1 Mar. 29, 2018

Related U.S. Application Data

(60) Provisional application No. 62/399,164, filed on Sep. 23, 2016.

(51) Int. Cl.
*H04R 1/08* (2006.01)
*H04R 1/06* (2006.01)

(52) U.S. Cl.
CPC ..... *H04R 1/08* (2013.01); *H04R 1/06* (2013.01); *H04R 1/086* (2013.01); *H04R 2201/003* (2013.01); *H04R 2499/11* (2013.01)

(58) Field of Classification Search
CPC ..... H04R 1/08; H04R 1/083; H04R 19/04; H04R 2201/003; H04R 2499/11; H04R 25/604; H04R 9/08; H04R 11/06
USPC ..... 381/368
See application file for complete search history.

(56) References Cited

U.S. PATENT DOCUMENTS

| | | | | |
|---|---|---|---|---|
| 6,883,380 | B2 | 4/2005 | Romo | |
| 8,171,873 | B2 | 5/2012 | Woolwright et al. | |
| 9,309,105 | B2 | 4/2016 | Dehe et al. | |
| 2003/0019298 | A1 | 1/2003 | Scheurich et al. | |
| 2008/0123891 | A1* | 5/2008 | Kato | H04M 1/03 381/361 |
| 2009/0279730 | A1 | 11/2009 | Sank | |
| 2012/0239343 | A1 | 9/2012 | Borkholder et al. | |
| 2014/0226826 | A1* | 8/2014 | Utterman | H04R 1/086 381/55 |
| 2015/0271610 | A1 | 9/2015 | Vandyke et al. | |
| 2016/0301998 | A1* | 10/2016 | Abe | H04R 1/086 |

* cited by examiner

*Primary Examiner* — Ahmad F. Matar
*Assistant Examiner* — Sabrina Diaz
(74) *Attorney, Agent, or Firm* — Womble Bond Dickinson (US) LLP

(57) ABSTRACT

An electronic device comprising having an enclosure with an enclosure wall separating a surrounding environment from an encased space. The enclosure wall includes a top portion having an acoustic channel extending from the encased space to the surrounding environment and a bottom portion. A microphone assembly module positioned within the encased space, and having a microphone acoustically coupled to a sound inlet port that is aligned with the acoustic channel and an air permeable water resistant membrane. A first support member is dimensioned to translatably couple the microphone assembly module to the top portion of the enclosure wall and translate the microphone assembly in response to a pressure change within the acoustic channel, and a second support member is dimensioned to translatably couple the microphone assembly module to the bottom portion of the enclosure wall.

20 Claims, 6 Drawing Sheets

SHOCK MOUNTED TRANSDUCER ASSEMBLY

CROSS-REFERENCE TO RELATED APPLICATION

This application claims the benefit of the earlier filing date of U.S. Provisional Patent Application No. 62/399,164, filed Sep. 23, 2016 and incorporated herein by reference.

FIELD

An embodiment of the invention is directed to a shock mounted transducer assembly, more specifically a microphone assembly that is movable within an enclosure in response to a pressure change so as to reduce an impact of the pressure change on the assembly components. Other embodiments are also described and claimed.

BACKGROUND

Cellular telephone handsets and smart phone handsets have within them a microphone that converts input sound pressure waves produced by the user speaking into the handset into an output electrical audio signal. The handset typically has a housing with an opening through which incoming sound pressure waves created by the user's voice can reach the microphone. This opening, however, can also allow for entry of short bursts of fluids such as gasses and liquids that cause rapid and short pressure changes within the system. If these rapid pressure changes reach the microphone and its associated components, they can cause damage to the various microphone components that are not designed to withstand such a force (e.g., membranes).

SUMMARY

An embodiment of the invention is directed to a transducer assembly having a transducer (e.g., a microphone assembly) that is soft mounted, or shock mounted, within an enclosure. In other words, the transducer is mounted such that it can move within the enclosure in response to, for example, a sudden pressure change or acoustic shock. Soft or shock mounting of the transducer provides several advantages. For example, the ability of the transducer to move within the enclosure may help to protect the assembly and its components from pressure changes caused by, for example, sudden impact events. In addition, it may smooth out transients due to rapid changes or oscillations in pressure. In the case of a microphone assembly, the microphone assembly may include, among other components, a microphone (e.g., a micro-electrical-mechanical system (MEMS) microphone) mounted to a flexible printed circuit (FPC) and a stiffener formed on the FPC to make it more rigid. In addition, in order to waterproof the microphone, an air permeable water resistant membrane may be placed over the opening to the microphone. The membrane may be designed to prevent water ingress when the microphone is placed under water and depending upon the pressure of the water, may deflect in response to the water pressure. A high pressure resulting in rapid deflections of the membrane may, however, be undesirable as this could cause damage to the membrane, for example, if the membrane repeatedly and abruptly contacts the underlying stiffener. Thus, the assembly may further include one or more support structures that allow for the microphone assembly to move or translate in response to a sudden or abrupt pressure change (e.g., such as that caused by diving into water) and reduce an impact of the pressure change on the membrane.

Representatively, in one embodiment, the invention includes an electronic device having an enclosure formed by an enclosure wall that separates a surrounding environment from an encased space. The enclosure wall may include a top portion having an acoustic channel extending from the encased space to the surrounding environment and a bottom portion. In one embodiment, a microphone assembly module may be positioned within the encased space. The microphone assembly module may have a microphone acoustically coupled to a sound inlet port that is aligned with the acoustic channel and an air permeable water resistant membrane positioned between the sound inlet port and the acoustic channel. The device may further include a first support member dimensioned to translatably couple the microphone assembly module to the top portion of the enclosure wall such that the microphone assembly module is operable to translate in a direction parallel to an axis of the acoustic channel in response to a pressure change within the acoustic channel. In addition, the device may include a second support member dimensioned to translatably couple the microphone assembly module to the bottom portion of the enclosure wall. The second support member may have a compliance sufficient to accommodate the translation of the microphone assembly module in response to the pressure change. In other words, the support member is compliant or resilient enough to deform and allow the microphone assembly module to compress it in response to the pressure change to reduce the impact pressure, in contrast to a stronger material, which does not compress unless subjected to a much higher force or pressure than the pressure change. In some embodiments, the microphone assembly module further includes a flexible printed circuit board to which the microphone is mounted, and a stiffening layer formed between the flexible printed circuit board and the air permeable water resistant membrane. The stiffening layer may include an opening aligned with the acoustic channel and the sound inlet port. The microphone may be a micro-electrical-mechanical system (MEMS) microphone. The first support member may be fixedly coupled to the microphone assembly module and translatably coupled to the acoustic channel. In other words, the first support member and the microphone assembly module may move together along the acoustic channel, which is stationary. For example, the first support member may include a base portion attached to the microphone assembly module and an extension portion extending from the base portion and into the acoustic channel. In some cases, the extension portion is dimensioned to slide within the acoustic channel in response to the pressure change. The first support member may include a surface area sufficient to, in response to the pressure change, drive movement of the microphone assembly module coupled to the first support member. For example, the first support member may include a surface area large enough to allow it to extend into the acoustic channel and within the pathway of the input pressure so that the resulting pressure on the first support member and moves the support member, and in some cases, deflects the input pressure away from the membrane.

In some embodiments, the first support member may include an extension member or portion that is sealed within the acoustic channel by an o-ring positioned between the extension member and the acoustic channel. The o-ring may be overmolded to the extension member. The o-ring may further include a hydrophobic coating that reduces a friction between the o-ring and the acoustic channel. In some embodiments, the second support member includes a foam material positioned between the microphone assembly module and the bottom portion. The second support member may include a compliance sufficient to reduce an impact of the pressure change on the air permeable water resistant membrane; for example, a compliance or resilience such that it compresses in response to the pressure change, and allows the microphone assembly to translate within the enclosure in a direction away from the input pressure. In some embodiments, the pressure change is a sudden pressure change to a pressure that is greater than a maximum pressure threshold of the air permeable water resistant membrane, and a translation of the microphone assembly module reduces a corresponding pressure on the air permeable water resistant membrane to below the maximum pressure threshold. The device may further include an acoustic mesh positioned between the acoustic channel and the air permeable water resistant membrane. The acoustic mesh may include a configuration suitable to reduce an impact of the pressure change on the air permeable water resistant membrane.

In another embodiment, the invention is directed to an electronic device having an enclosure made up of an enclosure wall separating a surrounding environment from an encased space. The enclosure wall may include a top portion having an acoustic channel that acoustically couples the encased space to the surrounding environment and a bottom portion. The device may further include a microphone assembly translatably positioned within the encased space. The microphone assembly may include a microphone acoustically coupled to a sound inlet port aligned with the acoustic channel and a protective membrane positioned over the sound inlet port. In addition, a support member may be dimensioned to translatably couple the microphone assembly to the enclosure wall and translate the microphone assembly in a direction parallel to an axis of the acoustic channel in response to a pressure change within the acoustic channel to reduce an impact of the pressure change on the protective membrane. The protective membrane may be an air permeable water resistant membrane. The protective membrane may have a maximum threshold pressure, and the impact of the pressure change on the protective membrane may be reduced to below the maximum threshold pressure. In some embodiments, the support member may include an extension member or portion positioned within the acoustic channel, and the extension member includes a top side having a surface area sufficient to receive a force corresponding to the pressure change and move the support member and microphone assembly toward the bottom portion of the enclosure to reduce the impact of the pressure change on the protective membrane. For example, the support member may include an extension member sealed within the acoustic channel, and the extension member may include an opening that acoustically couples the acoustic channel to the sound inlet port. In other embodiments, the support member may include a compliant member positioned between the microphone assembly and the bottom portion of the enclosure wall, and the compliant member may deform in response to the pressure change.

In another embodiment, the invention is directed to an electronic device including an enclosure having an enclosure wall separating a surrounding environment from an encased space. The enclosure wall may include a top portion having an acoustic channel that acoustically couples the encased space to the surrounding environment and a bottom portion. A transducer assembly may be translatably positioned within the encased space by a support member, and the support member may be dimensioned to translate the transducer assembly in a direction parallel to an axis of the acoustic channel in response to a pressure change within the acoustic channel to reduce an impact of the pressure change on the transducer assembly. For example, the transducer assembly may include a microphone assembly module including a micro-electrical-mechanical system (MEMS) microphone mounted to a printed circuit board, a sound inlet port to the MEMS microphone and an air permeable water resistant membrane positioned over the sound inlet port. The support member may translate the microphone assembly module to reduce a deflection of the air permeable water resistant membrane in response to the pressure change.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
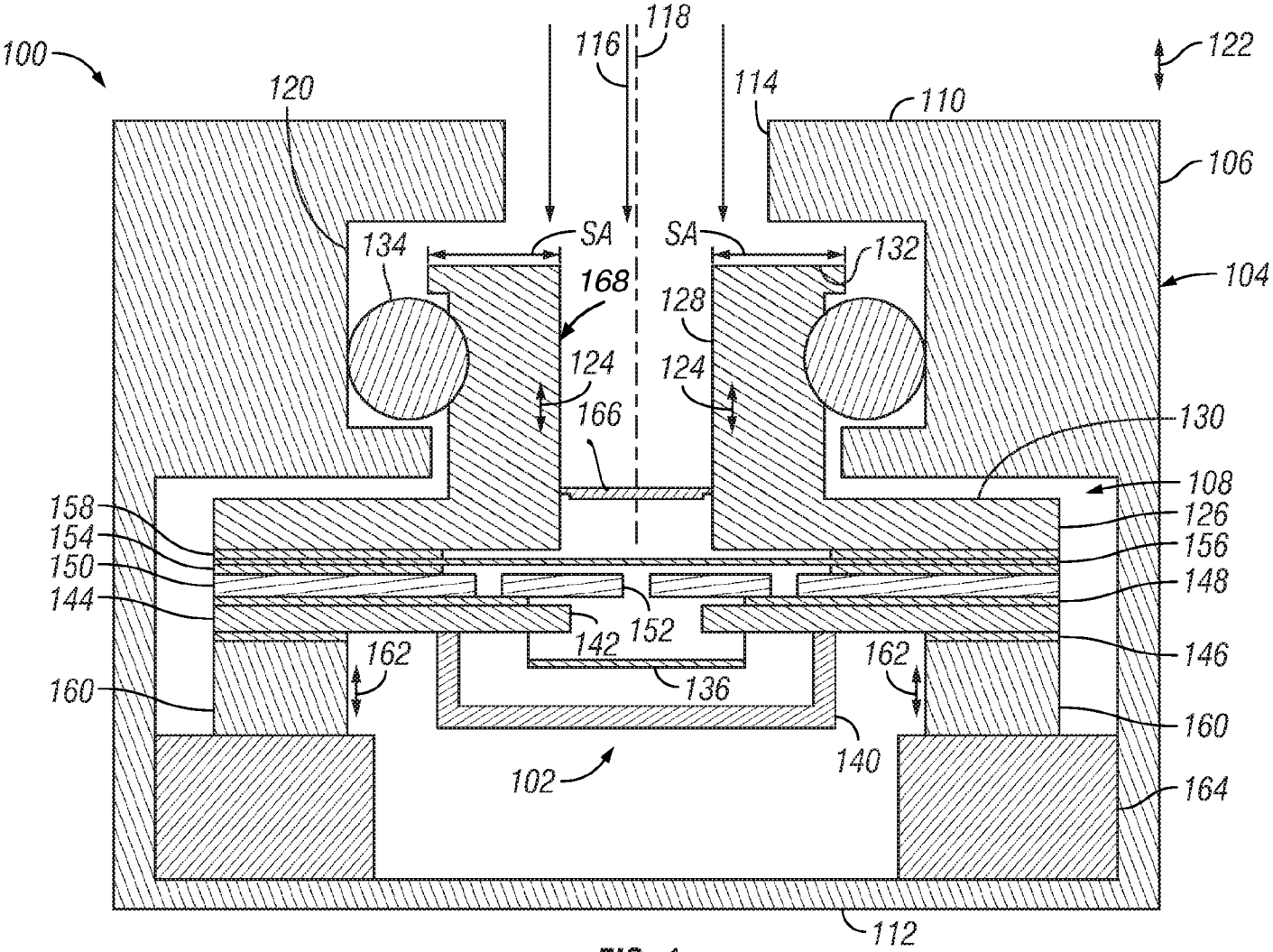
FIG. 1 illustrates a cross-sectional side view of one embodiment of a transducer assembly.

FIG. 1 illustrates a cross-sectional side view of one embodiment of transducer assembly. In some embodiments, transducer assembly 100 may include a microphone assembly 102 positioned within an enclosure 104. The enclosure 104 may be an outer enclosure or housing for the electronic device within which microphone assembly 102 is integrated (e.g., a smart phone case) or an inner casing or module which encloses only the microphone assembly 102 and is then mounted within the outer casing. In addition, while transducer assembly 100 is described as including a microphone assembly 102, it is contemplated that transducer assembly 100 may include other types of transducers capable of converting one form of energy to another (e.g., a speaker, an ambient pressure sensor, position sensor, or the like).

Referring now to enclosure 104, enclosure 104 may include an enclosure wall 106 that separates a surrounding environment from an encased space 108 formed within enclosure 104. The encased space 108 may be of a sufficient volume and/or size to accommodate microphone assembly 102 and any other associated components. The enclosure wall 106 may include a top portion 110 and a bottom portion 112 which are positioned on opposing sides of encased space 108. An acoustic channel 114 may be formed through top portion 110. Acoustic channel 114 may extend from encased space 108 to the surrounding environment. Thus, acoustic channel 114 may provide a passageway for sound pressure waves or a fluid pressure input in general (e.g., air or water) to reach encased space 108 within enclosure 104. For example, a pressure input 116 from the surrounding environment may travel along channel axis 118 of acoustic channel 114 to microphone assembly 102 within encased space 108. Acoustic channel 114 may therefore be considered to fluidly or acoustically couple encased space 108, and the components therein (e.g., microphone assembly 102), with the surrounding environment. It should be noted that the surrounding environment may, in some embodiments, be a completely open fluid space, or in other embodiments, a substantially closed space (e.g., a space enclosed between enclosure 104 and an outer casing).

Acoustic channel 114 may further include a track or recessed region 120 that can be used to help guide the movement (e.g., translation) of microphone assembly 102 within encased space 108. In particular, in some cases where pressure input 116 is a sudden or pulse pressure, it may exert a force or pressure on microphone assembly 102 and its associated components that can compromise their operation, as previously discussed. In order to reduce the impact, microphone assembly 102 can translate as shown by arrows 124 within encased space 108 when, for example, pressure input 116 is above a certain threshold. In other words, microphone assembly 102 can translate in a direction parallel to channel axis 118 (e.g., a z-direction 122). For example, where the pressure input 116 is in a downward direction as shown, microphone assembly 102 may move in a downward direction (e.g., away from a direction of the force and toward enclosure bottom portion 112) and redistribute or spread out the impact (e.g., force) along a larger surface area of the microphone assembly 102 thus reducing the impact on any particular component within microphone assembly 102.

Referring in more detail now to microphone assembly 102, microphone assembly 102 is made up of a stack-up of various microphone associated components. For example, microphone assembly 102 may include a microphone 136 positioned within a housing or casing 140, which is mounted to a printed circuit 144 including microphone circuitry for operating microphone 136. Microphone 136 may, for example, be a micro-electrical-mechanical system (MEMS) microphone that is made up of a pressure-sensitive diaphragm etched into a silicon wafer using MEMS processing techniques and mounted to printed circuit 144. It should be understood, however, that although a MEMS microphone is disclosed, other types of microphones or transducers (e.g., speaker, ambient pressure sensor, or the like) that could benefit from a reduced impact pressure could be used instead of a microphone. In addition, printed circuit 144 may, in some embodiments, be a flexible printed circuit (FPC) that includes a flexible substrate (e.g., a flexible plastic or polyester substrate) with circuitry printed thereon. An acoustic input port 142 to allow for sound input to microphone 136 may be formed within a portion of printed circuit 144 over microphone 136.

In addition, microphone assembly 102 may include a protective membrane 156 positioned over acoustic input port 142. Protective membrane 156 may be an air permeable water resistant membrane through which sound can pass to microphone 136 but which prevents water ingress into microphone 136. In addition, protective membrane 156 may be compliant, or otherwise have elastic deformation properties, such that it can flex or deflect and then return to its original position in response to a change in pressure input 116. For example, protective membrane 156 may deflect in response to a gradual or constant water pressure increase (e.g., such as when diving) and then return to its original position once the pressure is removed or otherwise reduced. Representatively, in one embodiment, protective membrane 156 may be a polytetrafluoroethylene (PTFE) membrane. Protective membrane 156 may, however, be made of any material suitable for forming an air permeable water resistant membrane.

In addition, a stiffening layer 150 may be positioned between protective membrane 156 and printed circuit 144 to provide structural stability to printed circuit 144 and/or protective membrane 156. Stiffening layer 150 may include an opening 152, which is aligned with acoustic channel 114 and acoustic input port 142 so that sound can pass through protective membrane 156 and stiffening layer 150 to microphone 136. Stiffening layer 150 may be made of any material suitable for providing structural stiffness or reinforcement to, for example, flexible printed circuit 144 (e.g., steel).

Each of the microphone assembly components may be assembled as a stack-up including each component attached together using, for example, layers of an adhesive material. Representatively, in one embodiment, microphone 136 and casing 140 may be mounted or otherwise attached to a bottom side of printed circuit 144 (a side facing bottom portion 112) using an adhesive or soldering, depending upon the desired connection. A bottom side of stiffening layer 150 may be attached to the top side of printed circuit 144 by adhesive layer 148. Protective membrane 156 may then be attached to a top side of stiffening layer 150 using adhesive layer 154 to complete the microphone assembly stack-up. Adhesive layers 148 and 154 may be, for example, layers of pressure-sensitive adhesive (PSA) (e.g., an elastomer based compound) that forms a bond when pressure is applied.

The microphone assembly 102 may then be translatably mounted within encased space 108 using support member 126 and support member 160. Representatively, support member 126 may be a first or top support member that is fixedly attached to a top side of microphone assembly 102 while support member 160 may be considered a second or bottom support member which is fixedly attached to a bottom side of microphone assembly 102. In this aspect, support member 126 is positioned between microphone assembly 102 and top portion 110 of enclosure wall 106. Support member 160 is positioned between microphone assembly 102 and bottom portion 112 of enclosure wall 106.

Referring in more detail now to support member 126, support member 126 may be dimensioned to attach or otherwise suspend microphone assembly 102 from top portion 110 of enclosure wall 106. Representatively, support member 126 may include a base portion 130 and an extension portion 128 extending from base portion 130. Base portion 130 may be a substantially horizontal or lateral member that is fixedly attached to the top side of microphone assembly 102. More specifically, base portion 130 may have a bottom side that is attached to a portion of the top side of protective membrane 156 by adhesive layer 158 (e.g., PSA adhesive layer). Extension portion 128 may be a vertically extending portion that is substantially perpendicular to base portion 130 and positioned within acoustic channel 114. Extension portion 128 may include a top end 132 and an opening 168 extending from top end 132 through base portion 130 so that sound entering acoustic channel 114 can pass through extension portion 128 to microphone assembly 102. For example, opening 168 may be aligned with, and in some cases positioned concentrically inward to, acoustic channel 114 and positioned over protective membrane 156.

As previously discussed, in some cases (e.g., a sudden pressure input), it may be desirable to reduce the impact of this pressure change within acoustic channel 114 on protective membrane 156. Said another way, it is desirable to reduce a deflection of the protective membrane 156 in response to the pressure change. The top end 132 of extension portion 128 may therefore have a surface area (SA) dimensioned to help redistribute pressure input 116 away from protective membrane 156 and allow support member 126 (and associated microphone assembly 102 including protective membrane 156) to move (translate) in a direction away from the direction of pressure input. In this aspect, the impact pressure or force of pressure input 116 is redistributed along the entire assembly, and therefore only a portion of the pressure input 116 impacts protective membrane 156, thereby reducing membrane deflection. For example, in one embodiment, the surface area (SA) of top end 132 may be greater than a surface area of protective membrane 156 exposed to pressure input 116 (e.g., area exposed through opening 168). Said another way, top end 132 may have a surface area (SA) such that it extends into, or partially occludes, acoustic channel 114. In this aspect, a portion of pressure input 116 through acoustic channel 114 is deflected or redirected away from protective membrane 156 and pushes against top end 132 of support member 126, which in turn, pushes support member 126 (and microphone assembly 102) down toward the bottom portion 112 of enclosure 104. As a result, the impact pressure from pressure input 116 that actually reaches protective membrane 156 is reduced to, for example, a level below the maximum threshold pressure of protective membrane 156.

To further facilitate the sealing and sliding (or translation) of extension portion 128 within acoustic channel 114 as indicated by arrows 124, acoustic channel 114 may include a recessed region 120 dimensioned to receive an o-ring 134 positioned around extension portion 128. In particular, recessed region 120 may be an annularly shaped recess formed within the inner surface of acoustic channel 114. Recessed region 120 may have a height sufficient to accommodate a sliding movement of o-ring 134 therein and overall width to allow for sealing between o-ring 134 and the inner surface of acoustic channel 114. O-ring 134 may be, for example, an elastomeric loop positioned around the outer surface of extension portion 128, and in some cases within a channel around the outer surface of extension portion 128. For example, in one embodiment, o-ring 134 is fixedly attached to extension portion 128 such that it does not move with respect to extension portion 128, rather it translates along with extension portion 128 within acoustic channel 114. Representatively, o-ring 134 may be formed by overmolding, or injection molding, an elastomeric ring within an annularly shaped channel formed around extension portion 128. It is also contemplated that in some embodiments, o-ring 134, or another similarly shaped gasket structure may be molded, or otherwise mounted, along the inner surface of acoustic channel 114. In such embodiments, o-ring 134 is therefore fixed to acoustic channel 114 and does not move as extension portion 128 slides within acoustic channel 114. In either case, it is important that o-ring 134 also provide a seal between extension portion 128 and acoustic channel 114 such that, for example, a fluid such as water or air is prevented from passing around extension portion 128 and into encased space 108.

In addition, in some embodiments, it may be desirable to reduce a friction between o-ring 134 and acoustic channel 114 such that extension portion 128 can slide or translate within acoustic channel 114 more easily. In such embodiments, o-ring 134 may include a surface finish or coating which reduces a friction or surface energy between o-ring 134 and the surface of acoustic channel 114, while still allowing for sealing between the two. For example, o-ring 134 may be coated with a hydrophobic coating (e.g., a thin polytetrafluoroethylene (PTFE) fluoropolymer coating).

Referring in more detail now to bottom support member 160, bottom support member 160 may further be configured to facilitate the translation of microphone assembly 102 and reduce a pressure impact on protective membrane 156. Representatively, bottom support member 160 may be positioned below microphone assembly 102 and help to absorb the pressure shock associated with a sudden or pulse pressure input 116. This, in turn, reduces the impact of this pressure on protective membrane 156, and/or microphone assembly 102 in general. In this aspect, bottom support member 160 may be a compliant, elastic or deformable structure that is capable of deforming or compressing in response to a pressure input, and then returning to its original configuration once the pressure is removed or reduced as illustrated by arrows 162. Representatively, bottom support member 160 may be formed of a compliant or resilient foam material that is of a compliance or resilience sufficient to deform when microphone assembly 102 is pressed toward the bottom portion 112 of enclosure 104 by pressure input 116. As previously discussed, the pressure input 116 may be a sudden or pulse pressure input which is greater than a maximum threshold pressure of protective membrane 156, thus bottom support member 160 may have a compliance or resilience sufficient to allow it to deform in response to a pressure input 116 above the maximum threshold pressure of protective membrane 156. In addition, bottom support member 160 should have a compliance or resilience sufficient to allow it to return back to its original configuration once the pressure is removed or otherwise reduced below the threshold pressure. In this aspect, top support member 126 and bottom support member 160 work together to facilitate translation of microphone assembly 102 in the direction illustrated by arrows 124, 162 (e.g., a z-direction 122 parallel to the axis 118 of acoustic channel 114) in response to an undesirable pressure change (e.g., pulse pressure) within acoustic channel 114 and reduce an impact pressure on protective membrane 156.

In one embodiment, bottom support member 160 may, for example, be a ring of foam that is positioned outward of microphone casing 140 and attached along a top side to printed circuit 144 by adhesive layer 146. Bottom support member 160 may further include a bottom side attached (e.g., by another PSA layer) to a bracket 164 mounted to bottom portion 112 of enclosure 104. In this aspect, bottom support member 160 may be considered fixedly attached to both microphone assembly 102 and enclosure 104, but because of its compliance can deform in a direction of arrows 162 (e.g., a z-direction 122) and facilitate translation of microphone assembly 102. In other embodiments, bottom support member 160 may include multiple layers of foam having different compliances (e.g., a high compliance foam and a low compliance foam), a spring, or be composed of any other type of structure or material suitable for facilitating translation of microphone assembly 102. It is noted, however, that the overall compliance or resilience of bottom support member 160 should be greater than that of a foam or other compliant material used for the purpose of absorbing acoustic vibrations associated with microphone assembly 102 and which would be too strong to allow for translation of microphone assembly 102 as discussed herein.

In addition, in some embodiments, transducer assembly 100 may include an acoustic mesh 166 to further reduce an impact of pressure input 116 on protective membrane 156. Representatively, acoustic mesh 166 may be positioned within opening 168 of support member 126 and within the pathway between pressure input 116 and protective membrane 156. Pressure input 116 must therefore travel through acoustic mesh 166 before reaching protective membrane 156. Acoustic mesh 166 may have a density, pore size, or other property, sufficient to slow, deflect, disperse or absorb some of pressure input 116 such that the corresponding impact force or pressure which reaches protective membrane 156 is less than the total input pressure entering acoustic channel 114. For example, in one embodiment, acoustic mesh 166 is made up of strands of a material (e.g., a metal, fiber or other flexible material) that are interconnected and form holes or pores dispersed throughout the mesh. The holes or pores may be of a size sufficient to allow for air passage and achieve a mesh with the desired acoustic properties yet deflect, disperse or otherwise slow down the passage of other fluids, for example, water. In this aspect, an impact of any portion of pressure input 116 not already deflected or dispersed by support member 126 and the movement of microphone assembly 102, is further reduced by acoustic mesh 166. Acoustic mesh 166 may, in one embodiment, be positioned within opening 168 of extension portion 128 by mounting it to the sidewall of opening 168.

Figure 2:
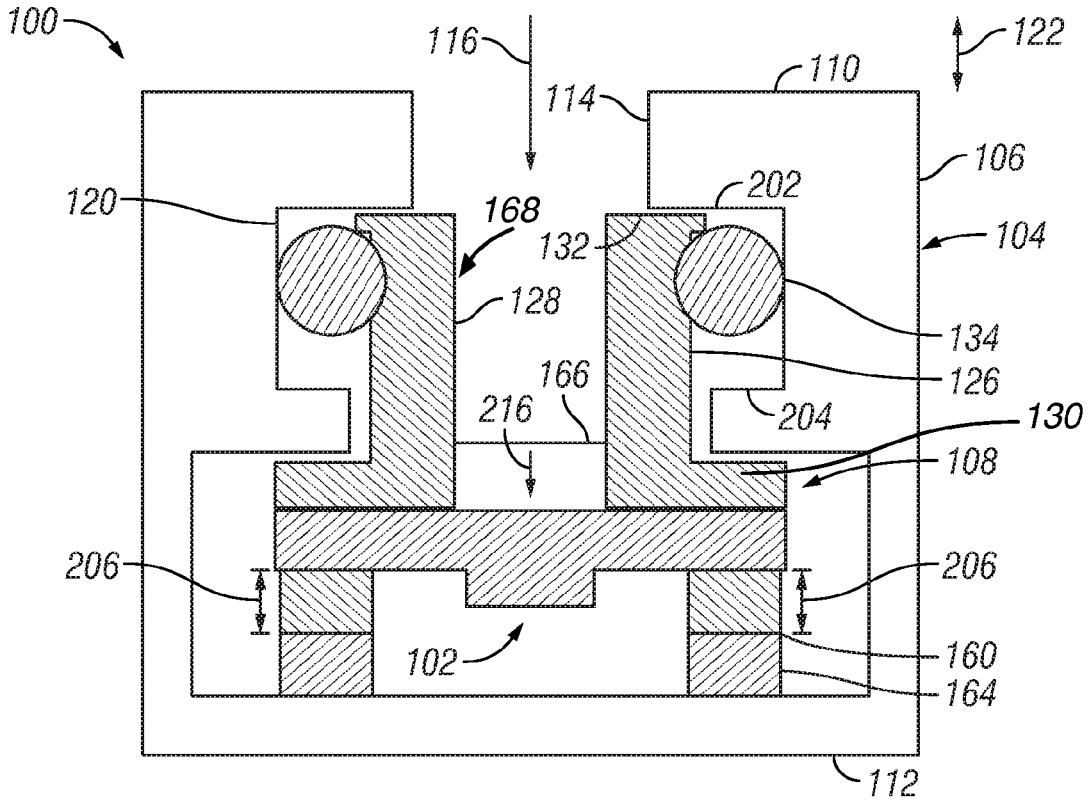
FIG. 2 illustrates a cross-sectional side view of the transducer assembly of FIG. 1 in a resting configuration.
Figure 3:
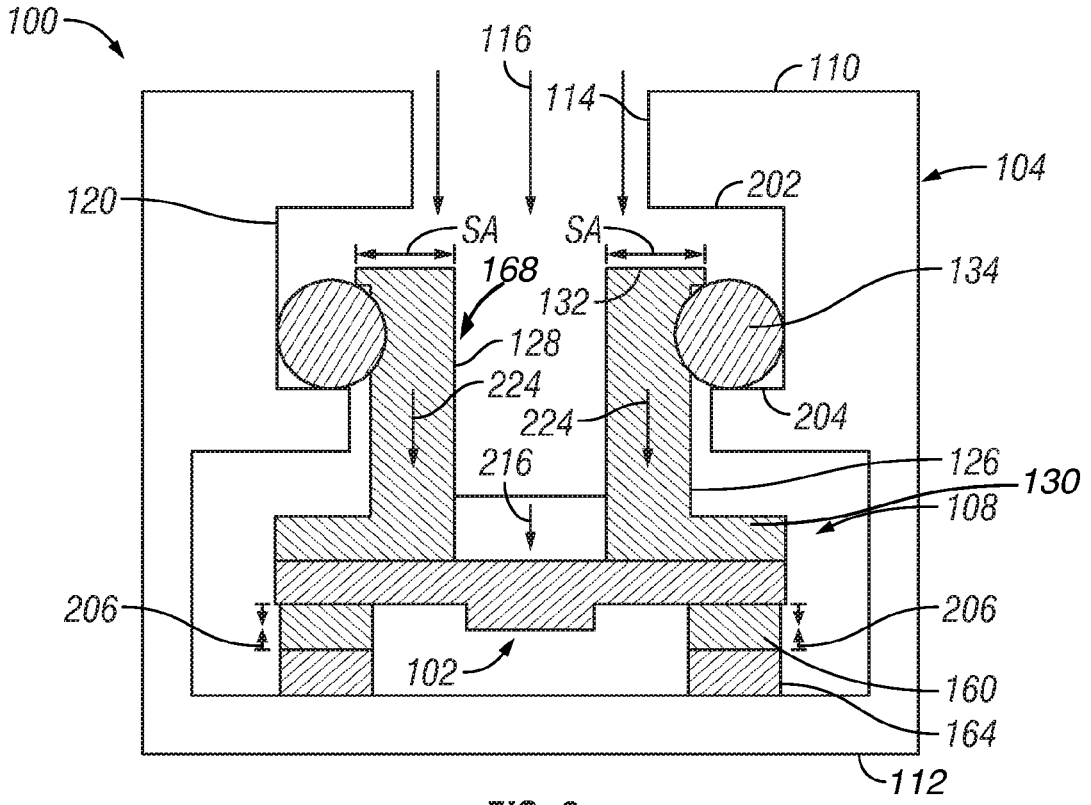
FIG. 3 illustrates a cross-sectional side view of the transducer assembly of FIG. 1 in a translated configuration.

The translation of microphone assembly 102 with respect to enclosure 104 will now be described in more detail in reference to FIG. 2 and FIG. 3. In particular, FIG. 2 and FIG. 3 illustrate the transducer assembly 100 of FIG. 1, except that in FIG. 2 microphone assembly 102 is shown in a resting configuration (e.g., low input pressure) and in FIG. 3 microphone assembly 102 is shown in a translated configuration (e.g. pulse pressure). Representatively, in FIG. 2, pressure input 116 is normal, or lower than a maximum threshold pressure of the protective membrane 156 of microphone assembly 102. Thus, support member 126 and microphone assembly 102 are not pushed down toward bottom portion 112 of enclosure 104 under the pressure. This is illustrated by the top end 132 of support member 126 being near the top edge 202 of recessed region 120 of acoustic channel 114 and bottom support member 160 being in its non-compressed state (e.g., not compressed in a direction of arrows 206). It should be understood that a "normal" pressure input 116 would be, for example, that which would be produced by a user speaking into the device, or an otherwise constant pressure that is typically input to a microphone. A sudden, rapid, pulse or otherwise undesirable input pressure would be one not associated with typical user interactions, for example, a sudden pressure change or increase that could occur during diving or dropping of the device within which transducer assembly 100 is implemented.

When the pressure input 116 within acoustic channel 114 changes, for example suddenly increases, as illustrated in FIG. 3 by the presence of multiple input pressure arrows, the pressure pushes support member 126, microphone assembly 102 and support member 160 down toward bottom portion 112 of enclosure 104. In particular, pressure input 116 applies a pressure to the top end 132 of support member 126, which as previously discussed has relatively large surface area (SA) which helps to disperse the pressure away from opening 168 to microphone assembly 102 and pushes support member 126 in a downward direction as illustrated by arrows 224 (e.g., toward bottom portion 112). Extension portion 128 and o-ring 134 are therefore near the bottom edge 204 of recessed region 120 and microphone assembly 102 is positioned closer to bottom portion 112 of enclosure 104. In addition, bottom support member 160 compresses and absorbs some of the pressure input and/or movement of microphone assembly 102. In other words, bottom support member 160 can act as a shock absorber for the entire assembly. Thus, the resulting impact force or pressure 216 on microphone assembly 102, and more specifically the protective membrane 156 as shown in FIG. 1, is reduced. For example, pressure input 116 may be reduced to an impact pressure 216 that is below a maximum pressure threshold of the protective membrane 156 as illustrated by FIG. 4.

Figure 4:
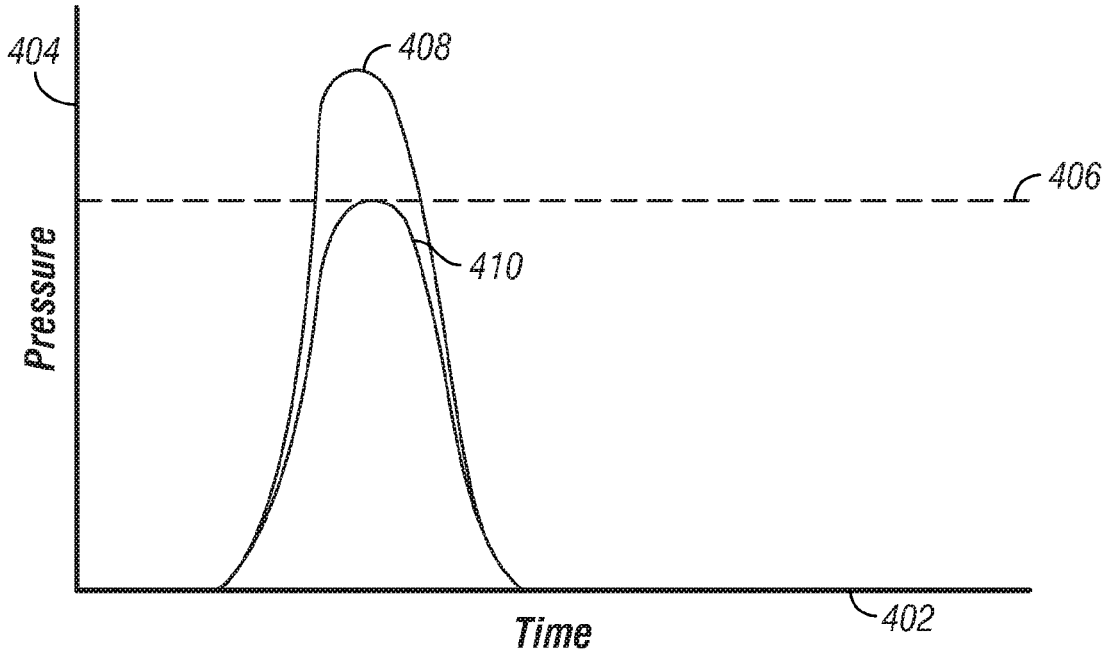
FIG. 4 illustrates a line graph of an input pulse pressure impact on the transducer assembly of FIG. 3.

FIG. 4 is a line graph showing a reduced pressure impact that can be achieved by transducer assembly 100. Representatively, the graph shows an x-axis representing time and the y-axis representing pressure. The maximum threshold pressure of a protective membrane associated with microphone assembly 102 (e.g., protective membrane 156 of FIG. 1) is illustrated by dashed line 406. The maximum threshold pressure is the maximum pressure that the protective membrane has been designed to withstand. A sudden or pulse pressure (e.g., pressure input 116) is illustrated by waveform 408, which shows a sudden spike in input pressure above the maximum threshold pressure 406 of the protective membrane. Because the pulse pressure is sudden and above the pressure limit of the membrane, it could potentially compromise the membrane structure and/or operation. The translation of the microphone assembly 102 as previously discussed, however, reduces the impact pressure to below the threshold pressure as illustrated by waveform 410. Thus, the impact pressure on microphone assembly 102, and more specifically the protective membrane, is within a range that will not negatively impact membrane operation.

Figure 5:
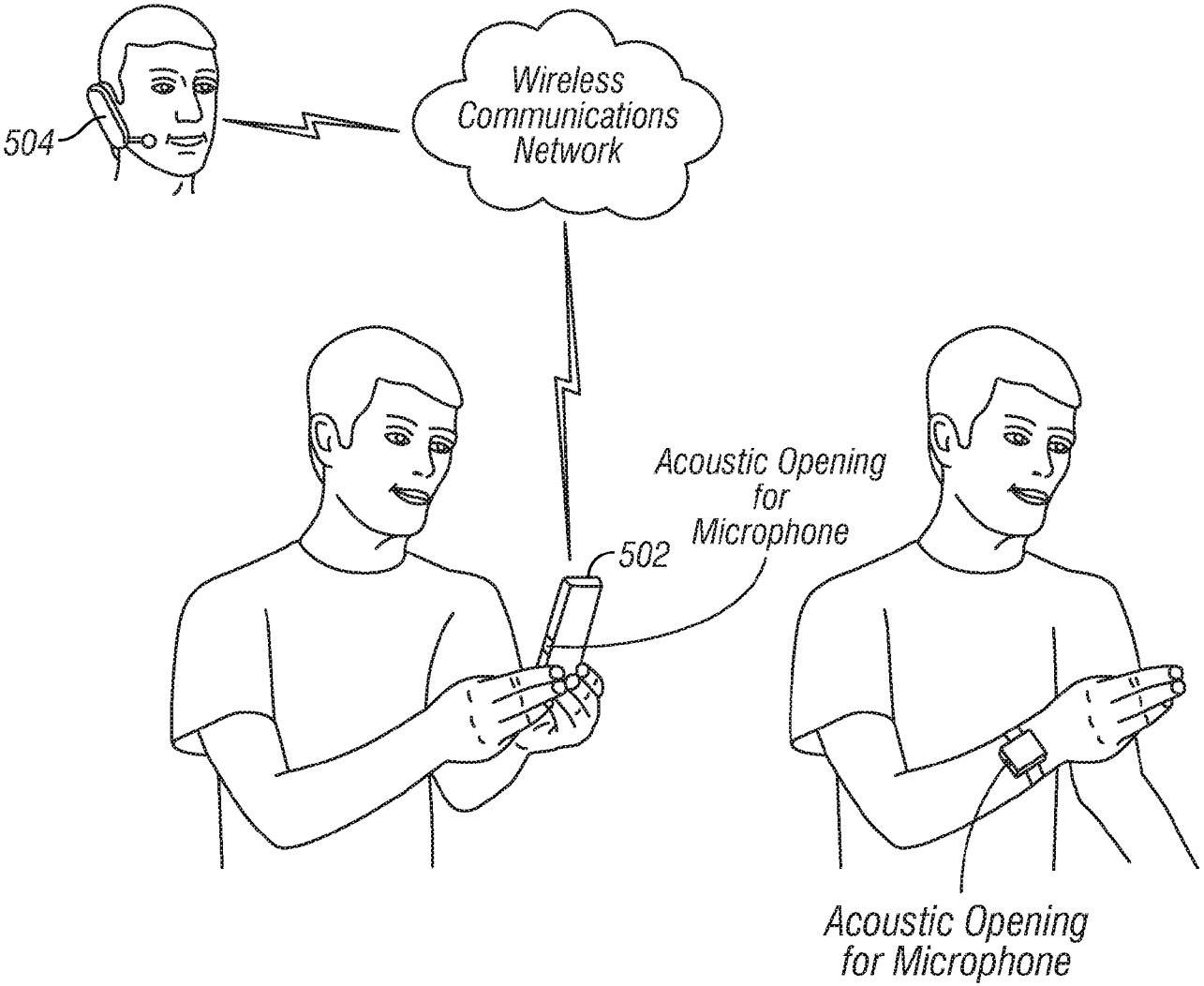
FIG. 5 illustrates a schematic diagram of embodiments of a portable electronic device.

FIG. 5 illustrates one embodiment of a simplified schematic view of embodiments of electronic devices in which a transducer assembly, such as that described herein, may be implemented. As seen in FIG. 5, the transducer may be integrated within a consumer electronic device 502 such as a smart phone with which a user can conduct a call with a far-end user of a communications device 504 over a wireless communications network; in another example, the transducer may be integrated within the housing of a portable timepiece. These are just two examples of where the transducer described herein may be used, it is contemplated, however, that the transducer may be used with any type of electronic device in which a transducer, for example, microphone, loudspeaker, receiver or sensor, is desired, for example, a tablet computer, a computing device or other display device.

Figure 6:
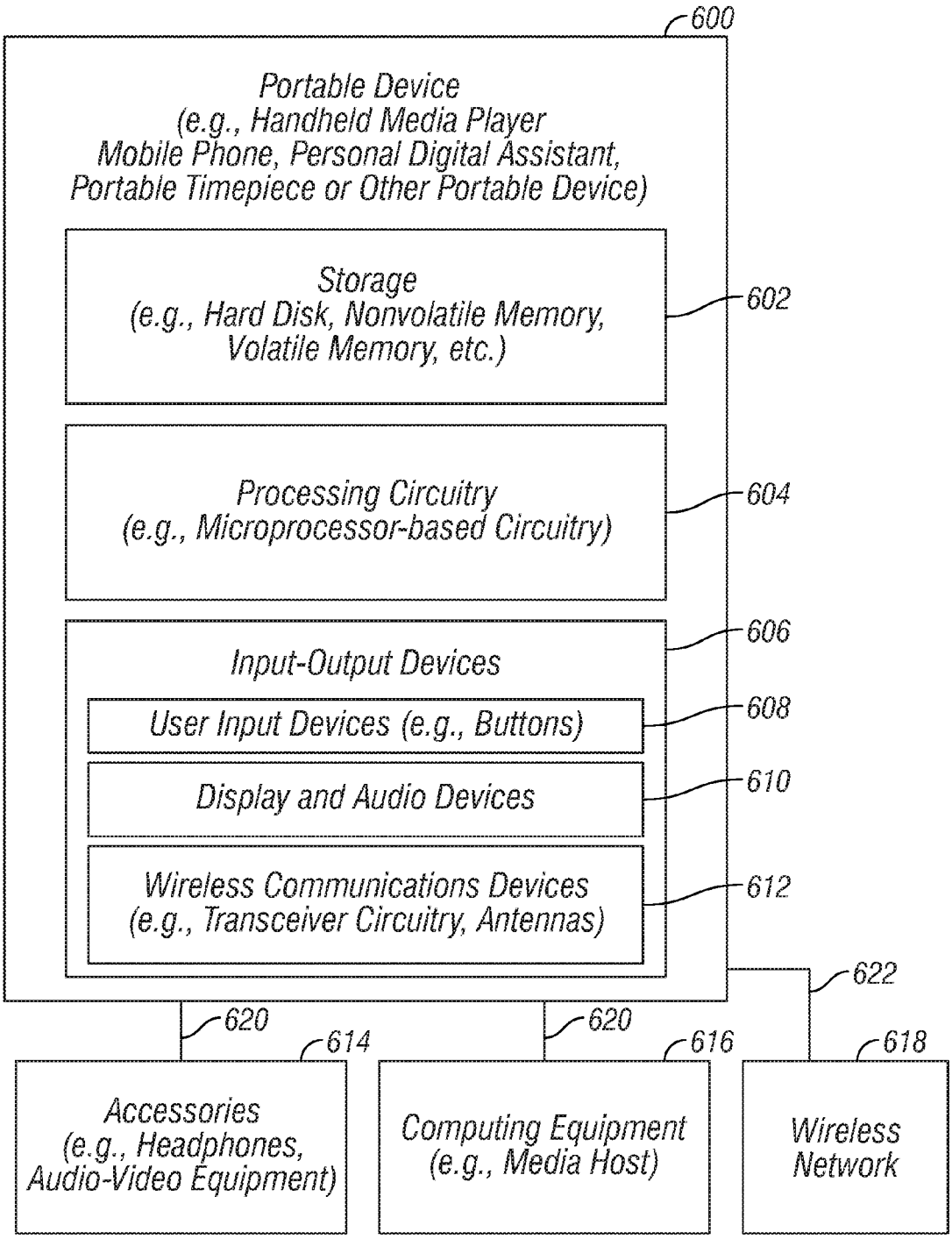
FIG. 6 illustrates a schematic diagram of one embodiment of a portable electronic device.

FIG. 6 illustrates a block diagram of one embodiment of an electronic device within which the previously discussed transducer assembly may be implemented. As shown in FIG. 6, device 600 may include storage 602. Storage 602 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 604 may be used to control the operation of device 600. Processing circuitry 604 may be based on a processor such as a microprocessor and other suitable integrated circuits. With one suitable arrangement, processing circuitry 604 and storage 602 are used to run software on device 600, such as internet browsing applications, voice-over-internet-protocol (VOIP) telephone call applications, email applications, media playback applications, operating system functions, etc. Processing circuitry 604 and storage 602 may be used in implementing suitable communications protocols. Communications protocols that may be implemented using processing circuitry 604 and storage 602 include internet protocols, wireless local area network protocols (e.g., IEEE 802.11 protocols—sometimes referred to as Wi-Fi®), protocols for other short-range wireless communications links such as the Bluetooth® protocol, protocols for handling 3G or 4G communications services (e.g., using wide band code division multiple access techniques), 2G cellular telephone communications protocols, etc.

To minimize power consumption, processing circuitry 604 may include power management circuitry to implement power management functions. For example, processing circuitry 604 may be used to adjust the gain settings of amplifiers (e.g., radio-frequency power amplifier circuitry) on device 600. Processing circuitry 604 may also be used to adjust the power supply voltages that are provided to portions of the circuitry on device 600. For example, higher direct-current (DC) power supply voltages may be supplied to active circuits and lower DC power supply voltages may be supplied to circuits that are less active or that are inactive. If desired, processing circuitry 604 may be used to implement a control scheme in which the power amplifier circuitry is adjusted to accommodate transmission power level requests received from a wireless network.

Input-output devices 606 may be used to allow data to be supplied to device 600 and to allow data to be provided from device 600 to external devices. Display screens, microphone acoustic ports, speaker acoustic ports, and docking ports are examples of input-output devices 606. For example, input-output devices 606 can include user input devices 608 such as buttons, touch screens, joysticks, click wheels, scrolling wheels, touch pads, key pads, keyboards, microphones, cameras, etc. A user can control the operation of device 600 by supplying commands through user input devices 608. Display and audio devices 610 may include liquid-crystal display (LCD) screens or other screens, light-emitting diodes (LEDs), and other components that present visual information and status data. Display and audio devices 610 may also include audio equipment such as speakers and other devices for creating sound. Display and audio devices 610 may contain audio-video interface equipment such as jacks and other connectors for external headphones and monitors.

Wireless communications devices 612 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications). Representatively, in the case of a microphone acoustic port as shown in FIG. 5, transducer assembly 100 may be associated with the port and be in communication with an RF antenna for transmission of signals from the transducer to a far end user. Such a configuration is illustrated in more detail in FIG. 7.

Figure 7:
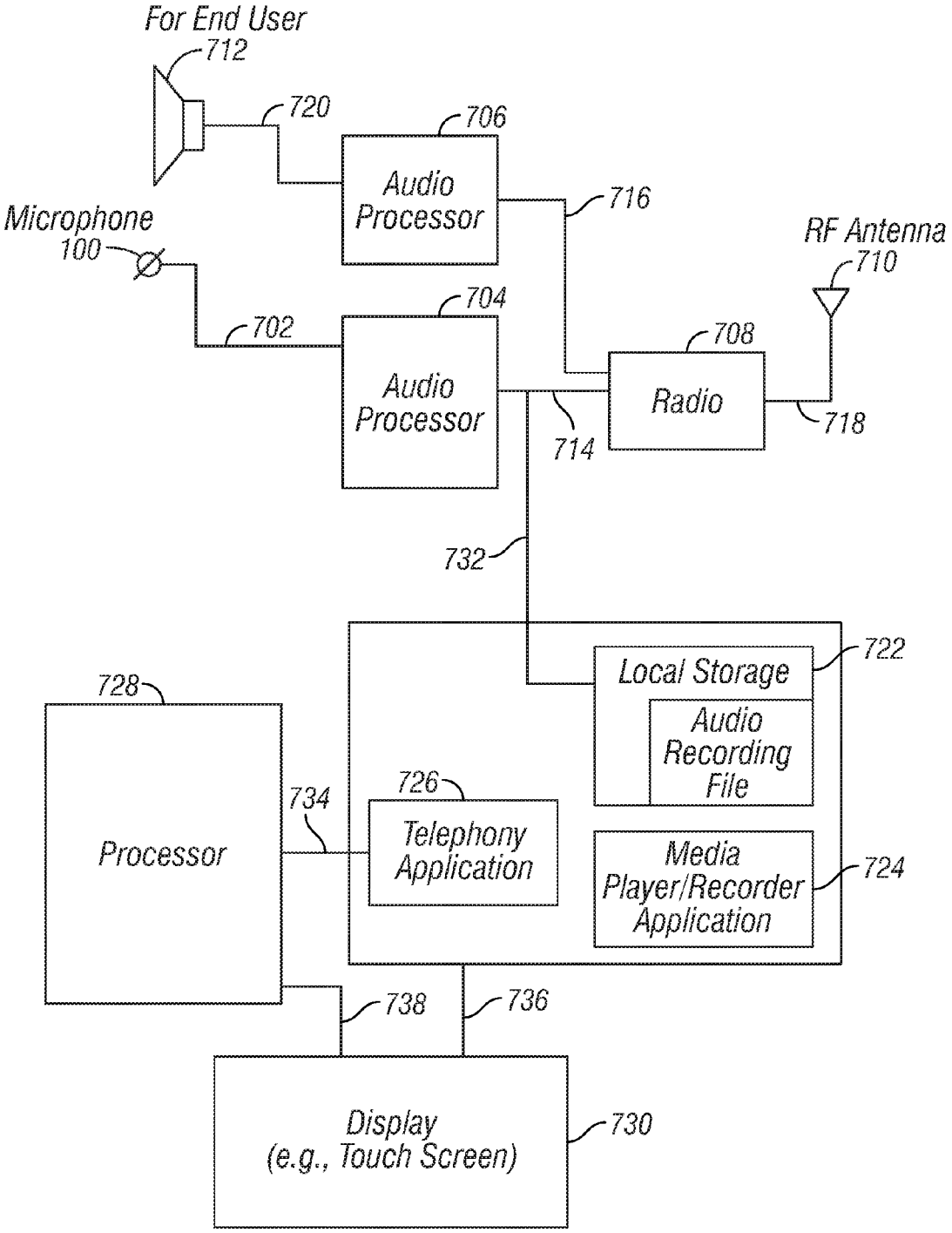
FIG. 7 illustrates a schematic diagram of one embodiment of circuitry of a portable electronic device within which the transducer assembly of FIG. 1 is integrated.

For example, FIG. 7 illustrates an embodiment of a device in which transducer assembly 100 (including microphone assembly 102) may be in communication with an audio processor 704 through path 702. Path 702 may include wired and wireless paths. Signals from transducer assembly 100 may be transmitted through uplink audio signal path 714 to radio 708. Radio 708 may transmit the signals via downlink audio signal path 716 to audio processor 706, which is in communication with a far end user device 712 through path 720. Alternatively, radio 708 may transmit the signals to RF antenna 710 through path 718. Audio processor 704 may also be in communication with local storage 722, a media player/recorder application 724 or other telephony applications 726 on the device, through path 732, for local storage and/or recording of the audio signals as desired. Processor 728 may further be in communication with these local devices via path 734 and also display 730 via path 738 to facilitate processing and display of information corresponding to the audio signals to the user. Display 730 may also be in direction communication with local storage 722 and applications 726 via path 736 as illustrated.

Returning to FIG. 6, device 600 can communicate with external devices such as accessories 614, computing equipment 616, and wireless network 618 as shown by paths 620 and 622. Paths 620 may include wired and wireless paths. Path 622 may be a wireless path. Accessories 614 may include headphones (e.g., a wireless cellular headset or audio headphones) and audio-video equipment (e.g., wireless speakers, a game controller, or other equipment that receives and plays audio and video content), a peripheral such as a wireless printer or camera, etc.

Computing equipment 616 may be any suitable computer. With one suitable arrangement, computing equipment 616 is a computer that has an associated wireless access point (router) or an internal or external wireless card that establishes a wireless connection with device 700. The computer may be a server (e.g., an internet server), a local area network computer with or without internet access, a user's own personal computer, a peer device (e.g., another portable electronic device 600), or any other suitable computing equipment.

Wireless network 618 may include any suitable network equipment, such as cellular telephone base stations, cellular towers, wireless data networks, computers associated with wireless networks, etc. For example, wireless network 618 may include network management equipment that monitors the wireless signal strength of the wireless handsets (cellular telephones, handheld computing devices, etc.) that are in communication with network 618.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, while the transducer assembly is disclosed as having a microphone assembly translatably coupled to the enclosure, it is contemplated that any type of transducer that could benefit from being movable within an enclosure as discussed could be used instead of a microphone, for example, a speaker or an ambient pressure sensor. Still further, although portable electronic devices such as mobile communications devices or portable timepieces are described herein, the transducer assembly may be implemented within a tablet computer, personal computer, laptop computer, notebook computer and the like. The description is thus to be regarded as illustrative instead of limiting.

What is claimed is:

1. An electronic device comprising:

an enclosure having an enclosure wall separating a surrounding environment from an encased space, wherein the enclosure wall comprises a top portion having an acoustic channel extending from the encased space to the surrounding environment and a bottom portion;

a microphone assembly module positioned within the encased space, the microphone assembly module having a microphone acoustically coupled to a sound inlet port that is aligned with the acoustic channel and an air permeable water resistant membrane positioned between the sound inlet port and the acoustic channel;

a first support member dimensioned to translatably couple the microphone assembly module to the top portion of the enclosure wall such that the microphone assembly module is operable to translate in a direction parallel to an axis of the acoustic channel in response to a pressure change within the acoustic channel; and a second support member dimensioned to translatably couple the microphone assembly module to the bottom portion of the enclosure wall, the second support member having a compliance sufficient to accommodate the translation of the microphone assembly module in response to the pressure change.

2. The device of claim 1 wherein the microphone assembly module further comprises a flexible printed circuit board to which the microphone is mounted, and a stiffening layer formed between the flexible printed circuit board and the air permeable water resistant membrane, the stiffening layer comprising an opening aligned with the acoustic channel and the sound inlet port.

3. The device of claim 1 wherein the microphone is a micro-electrical-mechanical system (MEMS) microphone.

4. The device of claim 1 wherein the first support member is fixedly coupled to the microphone assembly module and translatably coupled to the acoustic channel.

5. The device of claim 1 wherein the first support member comprises a base portion attached to the microphone assembly module and an extension portion extending from the base portion and into the acoustic channel, and wherein the extension portion is dimensioned to slide within the acoustic channel in response to the pressure change.

6. The device of claim 1 wherein the first support member comprises a surface area sufficient to, in response to the pressure change, drive movement of the microphone assembly module coupled to the first support member.

7. The device of claim 1 wherein the first support member comprises an extension portion that is sealed within the acoustic channel by an o-ring positioned between the extension portion and the acoustic channel.

8. The device of claim 7 wherein the o-ring is overmolded to the extension portion.

9. The device of claim 7 wherein the o-ring comprises a hydrophobic coating that reduces a friction between the o-ring and the acoustic channel.

10. The device of claim 1 wherein the second support member comprises a foam material positioned between the microphone assembly module and the bottom portion.

11. The device of claim 1 wherein the pressure change comprises a sudden pressure change to a pressure that is greater than a maximum pressure threshold of the air permeable water resistant membrane, and a translation of the microphone assembly module reduces a corresponding pressure on the air permeable water resistant membrane to below the maximum pressure threshold.

12. The device of claim 1 further comprising an acoustic mesh positioned between the acoustic channel and the air permeable water resistant membrane, the acoustic mesh comprising a configuration suitable to reduce an impact of the pressure change on the air permeable water resistant membrane.

13. An electronic device comprising:

an enclosure having an enclosure wall separating a surrounding environment from an encased space, wherein the enclosure wall comprises a top portion having an acoustic channel that acoustically couples the encased space to the surrounding environment and a bottom portion;

a microphone assembly translatably positioned within the encased space, the microphone assembly having a microphone comprising a sound inlet port aligned with the acoustic channel and a protective membrane positioned over the sound inlet port; and a support member dimensioned to translatably couple the microphone assembly to the enclosure wall and translate the microphone assembly in a direction parallel to an axis of the acoustic channel in response to a pressure change within the acoustic channel to reduce an impact of the pressure change on the protective membrane.

14. The device of claim 13 wherein the protective membrane is an air permeable water resistant membrane.

15. The device of claim 13 wherein the protective membrane comprises a maximum threshold pressure, and the impact of the pressure change on the protective membrane is reduced to below the maximum threshold pressure.

16. The device of claim 13 wherein the support member comprises an extension portion positioned within the acoustic channel, and the extension portion comprises a top side having a surface area sufficient to receive a force corresponding to the pressure change and move the support member and microphone assembly toward the bottom portion of the enclosure to reduce the impact of the pressure change on the protective membrane.

17. The device of claim 13 wherein the support member comprises an extension portion sealed within the acoustic channel, and the extension portion comprises an opening that acoustically couples the acoustic channel to the sound inlet port.

18. The device of claim 13 wherein the support member comprises a compliant member positioned between the microphone assembly and the bottom portion of the enclosure wall, wherein the compliant member deforms in response to the pressure change.

19. An electronic device comprising:

an enclosure having an enclosure wall separating a surrounding environment from an encased space, wherein the enclosure wall comprises a top portion having an acoustic channel that acoustically couples the encased space to the surrounding environment and a bottom portion; and a transducer assembly translatably positioned within the encased space by a support member, the support member is coupled to the transducer assembly and comprises an extension portion that extends from the transducer assembly into the acoustic channel, and the extension portion is configured to translate the transducer assembly in a direction parallel to an axis of the acoustic channel in response to a pressure change within the acoustic channel to reduce an impact of the pressure change on the transducer assembly.

20. The device of claim 19 wherein the transducer assembly is a microphone assembly module comprising a micro-electrical-mechanical system (MEMS) microphone mounted to a printed circuit board, a sound inlet port to the MEMS microphone and an air permeable water resistant membrane positioned over the sound inlet port, and the support member translates the microphone assembly module to reduce a deflection of the air permeable water resistant membrane in response to the pressure change.

* * * * *